US005971339A

United States Patent [19]

Falasco, Jr.

[11] Patent Number: 5,971,339

[45] Date of Patent: Oct. 26, 1999

[54] HANGING APPARATUS FOR A DUMBBELL

[76] Inventor: Leo A Falasco, Jr., 84-755 Upena Street, Makaha, Hi. 96792

[21] Appl. No.: 08/941,235

[22] Filed: Sep. 30, 1997

[51] Int. Cl.[6] ..... B42F 13/00

[52] U.S. Cl. ..... 248/339; 248/340; 248/175; 482/108; 482/109

[58] Field of Search ..... 248/339, 340, 248/690, 687, 175; 482/108, 109

[56] References Cited

U.S. PATENT DOCUMENTS

| | | | |
|---|---|---|---|
| 373,770 | 11/1887 | Duncan | 248/303 |
| 841,945 | 1/1907 | Doughty | 248/339 |
| 1,541,128 | 6/1925 | Ennis | 248/339 |
| 1,863,743 | 6/1932 | Burns | 248/340 |
| 2,216,876 | 10/1940 | Crum | 248/74.2 |
| 2,764,384 | 9/1956 | Kirsch | 248/305 |
| 2,949,510 | 8/1960 | Sichel | 248/205.5 |
| 3,182,942 | 5/1965 | Flanigan | 248/175 |
| 4,607,840 | 8/1986 | Harper | 272/117 |
| 4,743,017 | 5/1988 | Jaeger | 272/122 |
| 5,104,082 | 4/1992 | Bayer | 248/303 |
| 5,127,529 | 7/1992 | Martinez et al. | 211/37 |
| 5,350,345 | 9/1994 | Frey | 482/105 |
| 5,540,640 | 7/1996 | Povilaitis | 482/108 |
| 5,573,484 | 11/1996 | Carpenter | 482/108 |
| 5,616,108 | 4/1997 | Hayden | 482/104 |
| 5,628,716 | 5/1997 | Brice | 482/106 |
| 5,716,034 | 2/1998 | Unkefer | 248/211 |

*Primary Examiner*—Derek J. Berger
*Assistant Examiner*—Kimberly T. Wood
*Attorney, Agent, or Firm*—Michael I. Kroll

[57] ABSTRACT

A hanging apparatus (10) for a dumbbell (12) of the type having a straight cylindrical bar (14), a sleeve (16) on the straight cylindrical bar (14) and weights (18) at opposite ends. The hanging apparatus (10) comprises a frame (20) having a hook (22) at a first end. A structure (24) is for attaching a second end of the frame (20) to the straight cylindrical bar (14) of a dumbbell (12). The hook (22) will suspend the dumbbell (12) from a support shaft (26), enabling a person (28) using the dumbbell (12) not to reach down to a floor to pick up the dumbbell (12) and lower the dumbbell (12) back to the floor upon completion of a workout. These movements would put undue strain on forearm (30) and elbow joint ligaments and can cause severe damage to the entire arm muscles, tendons and tissues of the person (28).

1 Claim, 5 Drawing Sheets

HANGING APPARATUS FOR A DUMBBELL

BACKGROUND OF THE INVENTION

1. Field of the Invention

The instant invention relates generally to exercise equipment and more specifically it relates to a hanging apparatus for a dumbbell. The hanging apparatus for a dumbbell eliminates the need for a person to stretch when reaching down to pick up the dumbbell off of the floor. The present invention will suspend the dumbbell from a support shaft at a comfortable height, off of the floor for easy pick-up and return, therefore, preventing damage to muscle, tendon and arm tissues.

2. Description of the Prior Art

Weight lifting is a sports activity that may have any of several objectives. Weight lifting may be done competitively as a test of strength or as bodybuilding to increase muscle mass and definition. Many people also engage in weight lifting as part of an exercise regimen using it to build strength and stamina or as a part of physical therapy to speed recovery from an illness.

Weight lifting for physical conditioning is more properly called weight training. In addition to barbells and dumbbells, the equipment used in weight training may include a variety of other resistance devices, such as Nautilus machines. Many athletes, including football and baseball players, swimmers, bicyclists, golfers, and runners, engage in weight training to build their basic strength and to promote physical fitness. Physicians often prescribe supervised weight training as a means of regaining strength and coordination after an illness or injury.

Bodybuilding is a special branch of weight training that emphasizes symmetrical, balanced, and clearly defined muscular development. Specially devised exercises using dumbbells, barbells, and other types of equipment make it possible for the bodybuilder to exercise each part of the body and to develop muscle mass and definition to a remarkable extent. Bodybuilders engage in competitions where the judging is based on which contestant has the most impressive appearance rather than which is actually strongest.

Numerous exercise equipment have been provided in prior art, that are adapted to be utilized fore the purposes of enhancing muscular development. While these units may be suitable for the particular purpose to which they address, they would not be as suitable for the purposes of the present invention as heretofore described.

SUMMARY OF THE INVENTION

A primary object of the present invention is to provide a hanging apparatus for a dumbbell that will overcome the shortcomings of the prior art devices.

Another object is to provide a hanging apparatus for a dumbbell that contains a frame having a hook at a first end and the frame attached at a second end to the bar of the dumbbell, so that the hook will suspend the dumbbell from a support shaft, enabling a person using the dumbbell not to reach down to a floor to pick up the dumbbell, or lower the dumbbell back to the floor upon completion of a workout, in which these movements would put undue strain on forearm and elbow joint ligaments and can cause severe damage to the entire arm muscles, tendons and tissues.

An additional object is to provide a hanging apparatus for a dumbbell that has a foam pad on a hook end, so that it will function as an arm brace against a forearm of the person when doing curl lift exercises.

A further object is to provide a hanging apparatus for a dumbbell that is simple and easy to use.

A still further object is to provide a hanging apparatus for a dumbbell that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 4 is a front elevational view similar to

Figure 1:
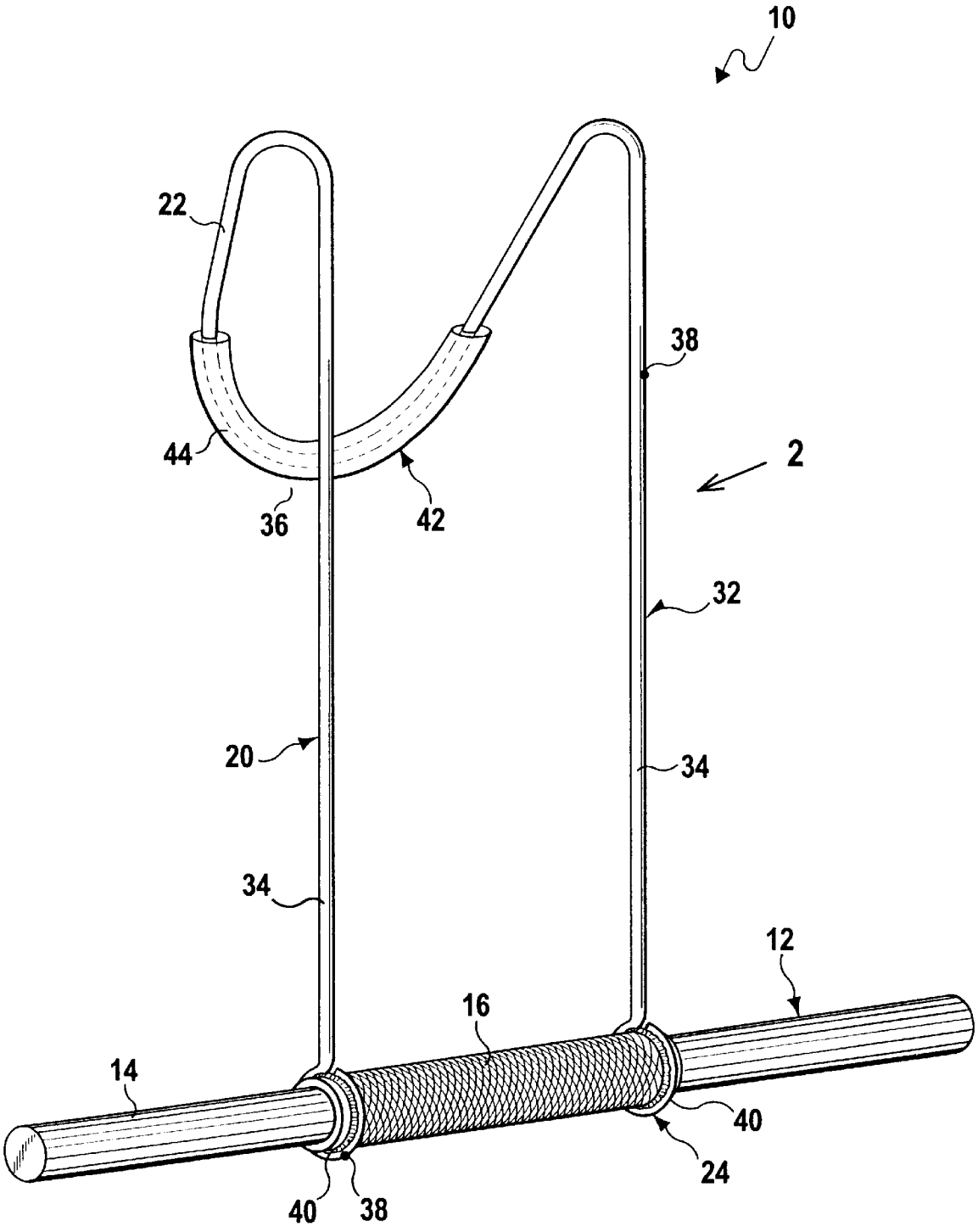
FIG. 1 is a front perspective view of the present invention attached to a bar of a barbell and the frame extending upwardly.
Figure 2:
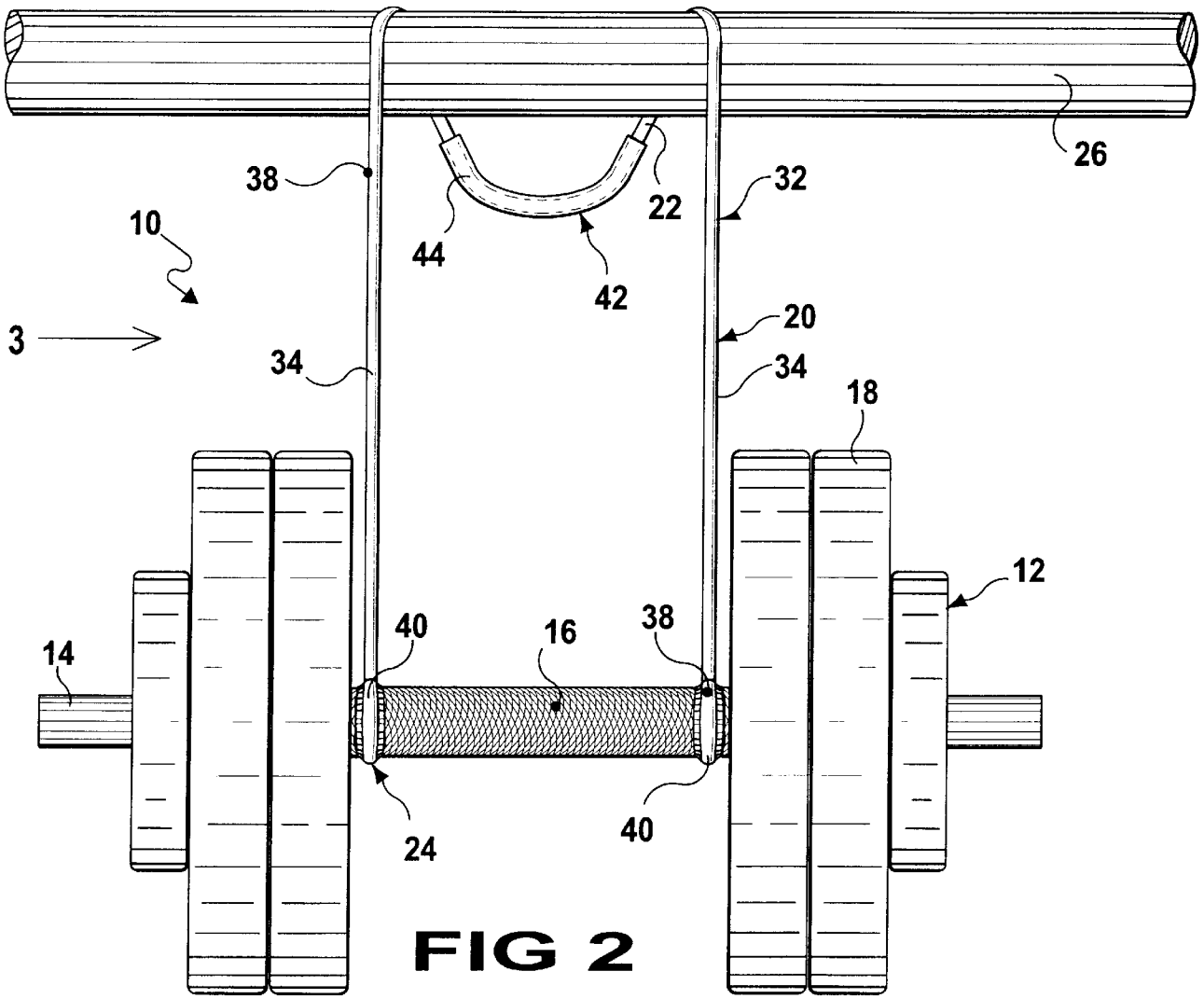
FIG. 2 is a front elevational view taken in the direction of arrow 2 in FIG. 1, with the hook end of the frame in engagement with a support shaft and weights placed on the bar.
Figure 3:
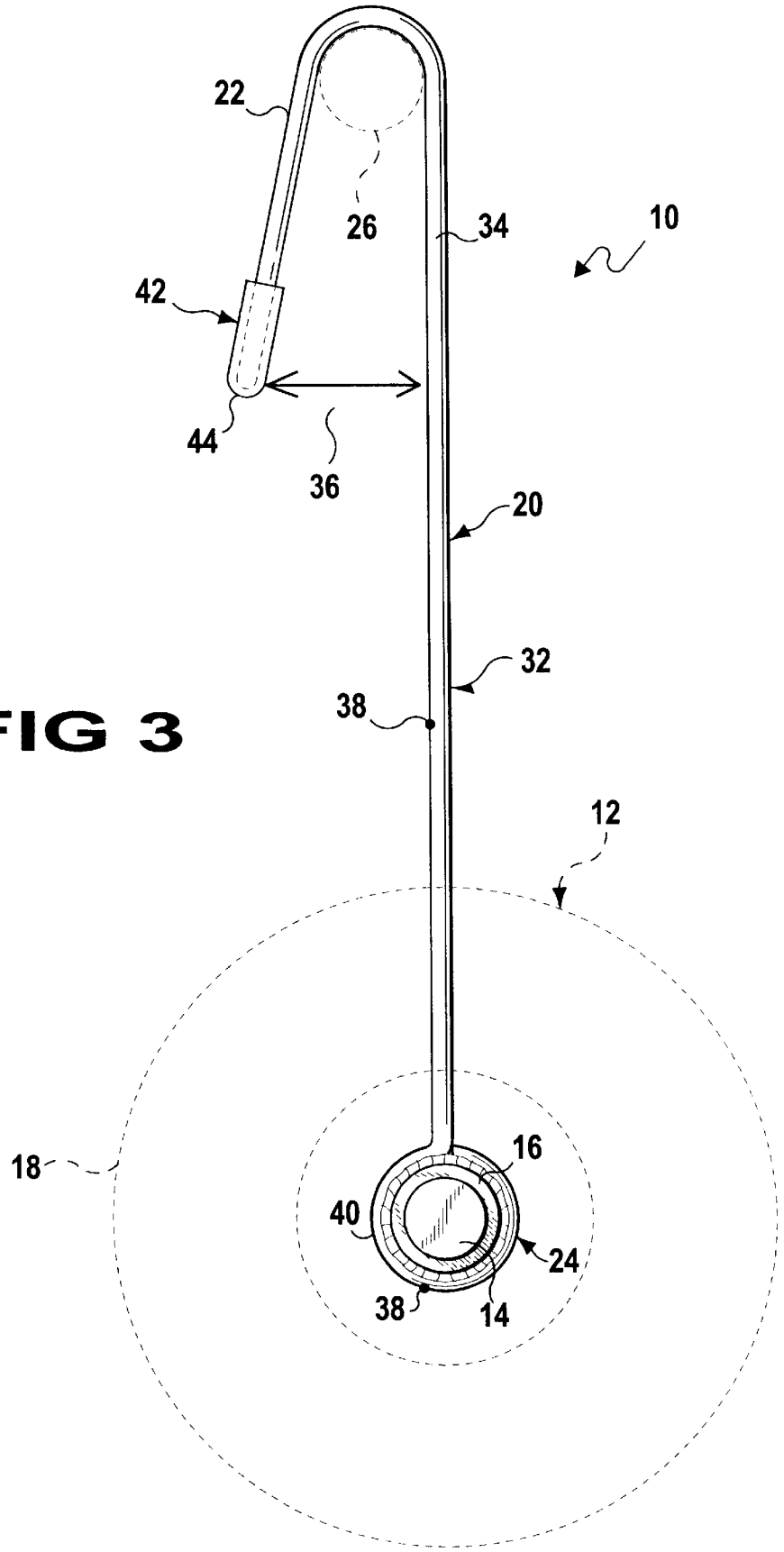
FIG. 3 is a side elevational view taken in the direction of arrow 3 in FIG. 2, showing the support shaft and the weights in dotted lines.

FIG. 2, showing the frame extending downwardly to function as an arm brace against the forearm of a person performing a curl lift exercise.

Figure 4:
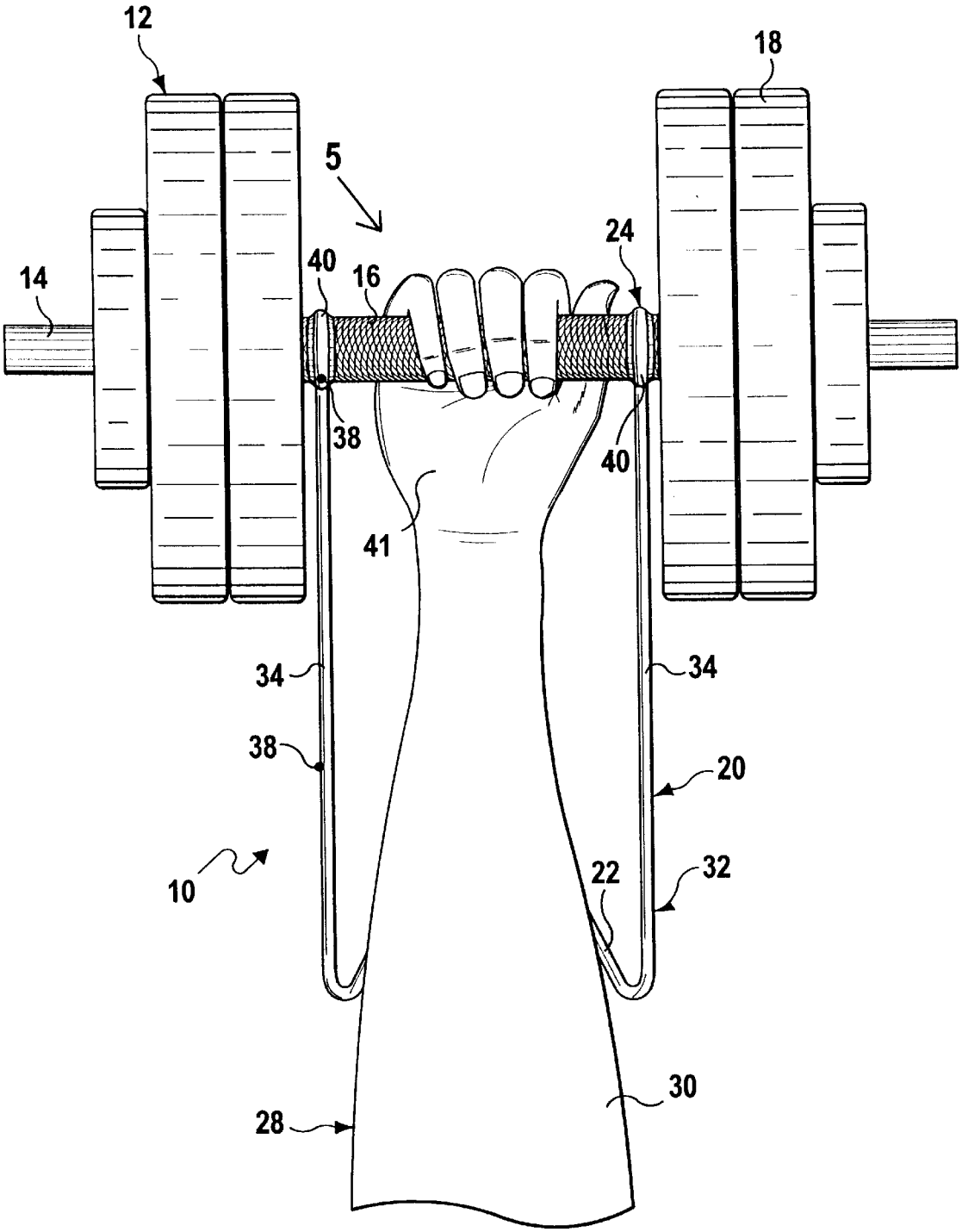
Figure 5:
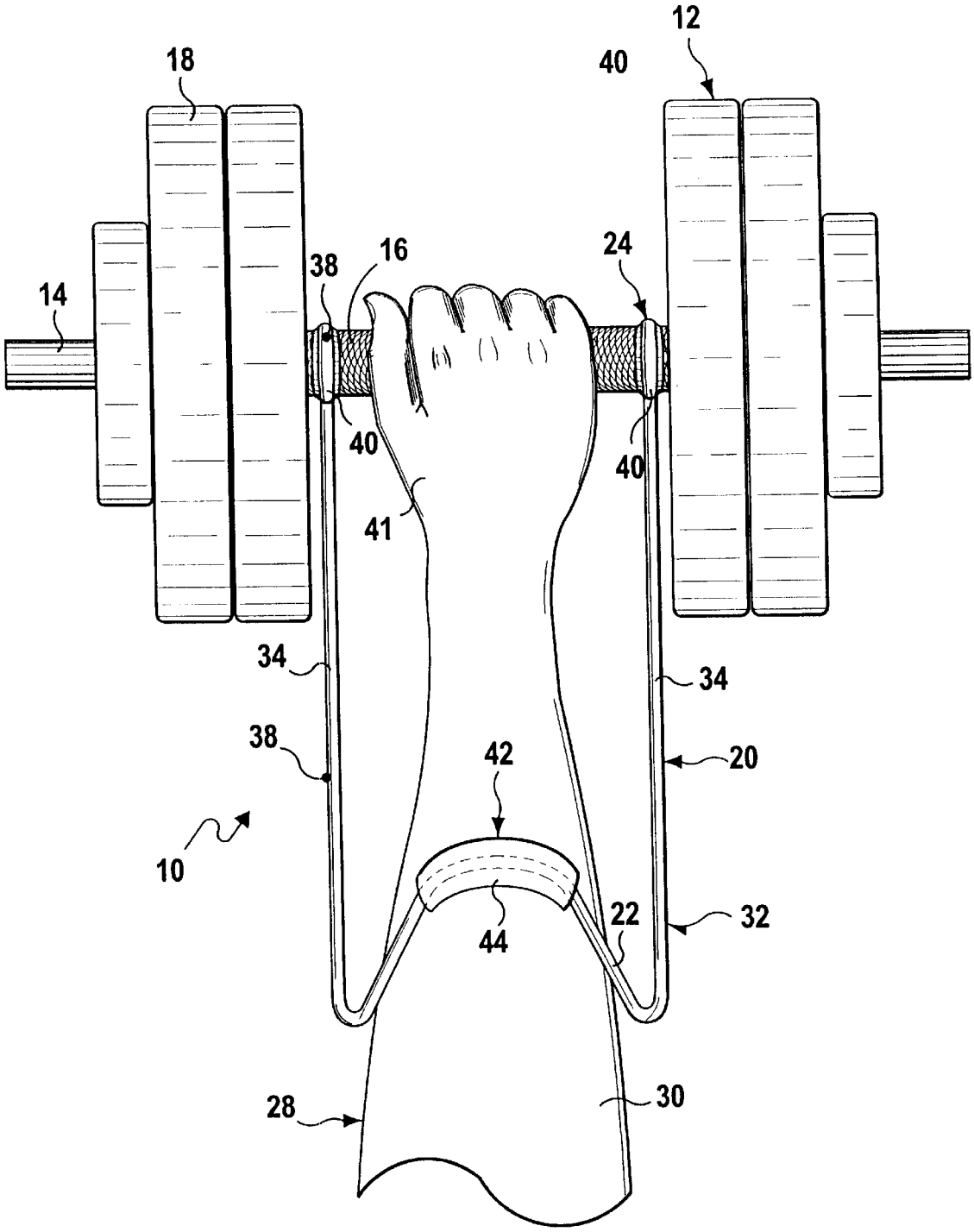

FIG. 5 is a rear elevational view taken in the direction of arrow 5 in FIG. 4.

Similar reference characters denote corresponding features consistently throughout the attached drawings.

DETAILED DESCRIPTION OF THE PREFERRED EMBODIMENTS

Turning now descriptively to the drawings, in which similiar reference characters denote similar elements throughout the several views, FIGS. 1 through 5 illustrate the present invention being a hanging apparatus 10 for a dumbbell 12. With regard to the reference numerals used, the following numbering is used throughout the various drawing figures.

| | |
|---|---|
| 10 | hanging apparatus |
| 12 | dumbbell |
| 14 | straight cylindrical bar of 12 |
| 16 | sleeve of 12 on 14 |
| 18 | weight of 12 on 14 |
| 20 | frame of 10 |
| 22 | hook on 20 |
| 24 | attaching structure of 10 |
| 26 | support shaft |
| 28 | person |
| 30 | forearm of 28 |
| 32 | wire loop for 20 |
| 34 | straight arm of 32 |
| 36 | expanded opening between 22 and 34 |
| 38 | durable strong material (metal) for 20 and 40 |

-continued

| | |
|---|---|
| 40 | clamp of 24 |
| 41 | hand |
| 42 | pad of 10 on 22 |
| 44 | cylindrical foam tube for 42 |

The dumbbell 12 has a straight cylindrical bar 14, a sleeve 16 on the straight cylindrical bar 14 and weights 18 at opposite ends. The hanging apparatus 10 comprises a frame 20 having a hook 22 at a first end. A structure 24 is for attaching a second end of the frame 20 to the straight cylindrical bar 14 of a dumbbell 12. The hook 22 will suspend the dumbbell 12 from a support shaft 26, enabling a person 28 using the dumbbell 12 not to reach down to a floor to pick up the dumbbell 12 and lower the dumbbell 12 back to the floor upon completion of a workout. These movements would put undue strain on forearm 30 and elbow joint ligaments and can cause severe damage to the entire arm muscles, tendons and tissues of the person 28.

The frame 20 is a wire loop 32 forming the hook 22, with two spaced apart straight arms 34 extending from the hook 22. The hook 22 is angled downwardly and outwardly away from the straight arms 34, thereby forming an expanded opening 36 to help aid the person 28 in suspending the dumbbell 12 from the support shaft 26. The frame 20 is fabricated out of a durable strong material 38, wherein the durable strong material 38 is metal.

The attaching structure 24 consists of a pair of clamps 40. Each clamp 40 located at an end of one straight arm 34 of the wire loop 32 of the frame 20 wraps about an end of the sleeve 16 on the straight cylindrical bar 14 of the dumbbell 12, so as to allow the person 28 to freely grasp the sleeve 16 by a hand 41 and lift the dumbbell 12 to disengage the hook 22 from the support shaft 26.

Each clamp 40 is fabricated out of the durable strong material 38, wherein the durable strong material 38 is metal. Each clamp 40 is integral with a respective straight arm 34 of the wire loop 32 of the frame 20.

The hanging apparatus 10 for a dumbbell 12 further contains a pad 42 carried on the hook 22 of the wire loop 32 of the frame 20. When the frame 20 extends downwardly from the straight cylindrical bar 14 of the dumbbell 12, as shown in FIGS. 4 and 5, the frame 20 will function as an arm brace with the pad 42 against the forearm 30 of the person 28, to perform curl lift exercises. The pad 42 is a cylindrical foam tube 44, which fits over a central portion of the hook 22 of the wire loop 32 of the frame 20.

The attaching structure 24, as shown in FIGS. 1 through 5, are a pair of clamps 40 integral with the straight arms 34. Other ways of attaching the frame 20 to the straight cylindrical bar 14 of the dumbbell 12 can be by using different types of clamps and by welding the straight arms 34 directly to the straight cylindrical bar 14.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of lifting weights using a dumbbell having a straight cylindrical bar with weights adjacent the two ends thereof comprising the steps of:

a) attaching said straight cylindrical bar between said weights to the distal ends of a U-shaped frame with the closed end of said frame being bent over untwisted to form a V-shaped hook;

b) placing said hook over a support bar thereby suspending said dumbbell above a floor; and c) grasping said bar between said weights and lifting and lowering said dumbbell away from said support bar without said dumbbell contacting the floor, said closed end of said U-shaped frame acting as a brace against a arm of the user when said dumbbell is being lifted and lowered by a user.

* * * * *